US007936548B2

(12) United States Patent
Dorn

(10) Patent No.: US 7,936,548 B2
(45) Date of Patent: May 3, 2011

(54) OVERCURRENT SWITCHING APPARATUS

(75) Inventor: Jörg Dorn, Buttenheim (DE)

(73) Assignee: Siemens Aktiengesellschaft, Munich (DE)

( * ) Notice: Subject to any disclaimer, the term of this patent is extended or adjusted under 35 U.S.C. 154(b) by 87 days.

(21) Appl. No.: 12/280,578

(22) PCT Filed: Feb. 23, 2006

(86) PCT No.: PCT/DE2006/000345

§ 371 (c)(1),
(2), (4) Date: Jan. 22, 2009

(87) PCT Pub. No.: WO2007/095874

PCT Pub. Date: Aug. 30, 2007

(65) Prior Publication Data

US 2009/0257165 A1 Oct. 15, 2009

(51) Int. Cl.
*H01H 73/00* (2006.01)

(52) U.S. Cl. ..... 361/100; 361/115

(58) Field of Classification Search ..... 361/42, 361/115, 100

See application file for complete search history.

(56) References Cited

U.S. PATENT DOCUMENTS

| | | | | |
|---|---|---|---|---|
| 6,242,845 | B1 * | 6/2001 | Colombo et al. | 310/317 |
| 2002/0118554 | A1 * | 8/2002 | Watanabe et al. | 363/39 |
| 2002/0171987 | A1 * | 11/2002 | Dudhwala et al. | 361/115 |

FOREIGN PATENT DOCUMENTS

| | | | |
|---|---|---|---|
| DE | 1047915 | B | 12/1958 |
| DE | 2360037 | A1 | 6/1975 |
| DE | 10002870 | A1 | 8/2001 |
| EP | 1526560 | A2 | 4/2005 |
| FR | 2575325 | A1 | 6/1986 |

OTHER PUBLICATIONS

European Office Action dated Dec. 8, 2010.

* cited by examiner

*Primary Examiner* — Danny Nguyen
(74) *Attorney, Agent, or Firm* — Laurence A. Greenberg; Werner H. Stemer; Ralph E. Locher

(57) ABSTRACT

In order to form an overcurrent switching apparatus for medium-voltage or high-voltage applications with a current detection device for changing over a contact system associated with them from a first state to a second state in the event of a threshold current being exceeded, the switching properties of which overcurrent switching apparatus are precise, an actuating device is disposed downstream of the current detection device, which is in a first current branch, via a coupling device. The actuating device is configured to change over the contact system, which is in a second current branch, from the first to the second state.

8 Claims, 1 Drawing Sheet

OVERCURRENT SWITCHING APPARATUS

BACKGROUND OF THE INVENTION

Field of the Invention:

The invention relates to an overcurrent switching apparatus for medium-voltage or high-voltage applications having current detection means for switching a contact system, which is associated with them, from a first state to a second state when a threshold current is exceeded.

An electronics module having an overcurrent switching apparatus such as this is known from international patent application PCT/DE 2005/001147, which is regarded as prior art. In this prior overcurrent switching apparatus, a connecting conductor has a deformable section as current detection means. The deformable section is deformed when a threshold current is exceeded, such that a contact system is switched from a first state to a second state. The deformable section is in this case also used to form the contact system in that, together with a contact part, it forms the contact system.

BRIEF SUMMARY OF THE INVENTION

The object of the present invention is to design an overcurrent switching apparatus which can be designed flexibly and precisely as appropriate for the respectively stated requirements.

According to the invention, this object is achieved in that the current detection means which are located in a first current branch are followed via coupling means by operating means which are designed to switch the contact system, which is located in a second current branch, from the first state to the second state.

One major advantage of the overcurrent switching apparatus according to the invention is that the current detection means as well as the coupling and operating means in it represent assemblies and elements, respectively, in their own right, and can therefore be designed in their own right and can have appropriate dimensions; this also applies to the contact system, because this forms a system in its own right, on which the operating means act. This all allows precise adjustment and a wide adjustment range for the threshold current, in which the contact system can be switched from its first state to its second state. In this case, the contact system can advantageously be used in a flexible form to the extent that the first state of the contact system may be the open state and the second state may be the closed state of the contact system, or vice versa, such that an opening or a closing overcurrent switching apparatus is provided in a simple manner, depending on the respective requirements. This also results in the advantageous capability to carry out a switching process in the second current branch when an overcurrent occurs in the first current branch.

In one preferred embodiment, the current detection means comprise two busbar sections which run parallel to one another, in which the current is carried in opposite senses and of which at least one section can be deformed, wherein the deformable section can be changed from a normal position to an operating position by the threshold current being exceeded. In a refinement such as this, an electromagnetic force advantageously acts between the parallel-running conductors which carry currents in opposite senses, such that the deformable section is deformed by this force when a threshold current is exceeded, and is changed from a normal position to an operating position. In this case, the threshold current can easily and flexibly be adjusted via the deformation capability of the deformable section.

In a further refinement of the invention, the coupling means comprise a blocking element which is firmly connected to the deformable section. A blocking element such as this, for example a holding pin, is a simple option for coupling the current detection means to the operating means.

In one preferred embodiment, the operating means comprise an operating member which can be spring-loaded and is designed such that, when a blocking element is in the normal position of the deformable section, the operating member is held in a position with a stressed spring and is released in an operating position of the deformable section. An operating member such as this can be released in a simple manner by the blocking element, thus advantageously allowing the contact system to be switched quickly from its first state to its second state.

The operating member may be formed in various ways, for example as a plunger. In one particularly preferred refinement, the operating member is a moving carriage which can be stressed by means of the spring and has a rigidly connected guide rod. A carriage such as this can particularly advantageously be held or released by the blocking element.

In a further refinement, the contact system is formed from a moving contact which is rigidly connected to the operating means, in order to form a conductive connection between a first and a second opposing contact. The opposing contacts may in this case both be in the form of fixed contacts. If required, it may also be advantageous for one opposing contact to be in the form of a fixed contact and for the other opposing contact to be in the form of a flexible contact, in which case, for example, the flexible contact can be produced using a flexible connecting line. A contact system such as this can easily be switched from its first state to its second state by the operating means.

In another preferred embodiment, the current detection means comprise a coil which surrounds connecting conductors which carry the current. A coil allows an overcurrent to be detected in a precise manner since a current flowing in the connecting conductor in the coil induces a voltage by means of which the operating means can be operated in a simple manner.

In a further refinement of the invention, the contact system comprises an electrical switch which is connected to the coil via the coupling means and the operating means and which can be switched from the first state to the second state by a voltage induced in the coil when the threshold current is exceeded. An electrical switch advantageously has fast and precise adjustable switching characteristics in order to switch the contact system from the first state to the second state, with the switch being designed such that it remains in the second state, once it has been switched to this state.

In one expedient embodiment, the electrical switch is a thyristor. A thyristor is a precise electronic switching element as an electrical switch, which can easily be operated directly by the voltage induced in the coil.

In another embodiment, the electrical switch is an electromagnetically operated switch. An electromagnetically operated switch which is controlled by the coil allows precise and fast switching in a simple manner.

In a further refinement, the operating means comprise a control apparatus for the electrical switch. A control apparatus is advantageous for precise adjustment of the threshold current to be detected.

The invention also relates to a bridging apparatus for an electronics module, such as that disclosed in the prior international patent application PCT/DE 2005/001147 which was mentioned initially, and has the object of developing a bridging apparatus such as this for an electronics module such that it has a flexible design with a precise adjustable threshold current.

According to the invention, a bridging apparatus for an electronics module is used to achieve the object, having an overcurrent switching apparatus in one of the refinements described above, wherein the current detection means are designed to switch the contact system associated with them from a first state, in which the electronics module is connected to a circuit arrangement, to a second state, in which the electronics module is bridged in the circuit arrangement, when a threshold current is exceeded in the electronics module. This bridging apparatus advantageously allows a flexible design with a precise adjustable threshold current. The bridging apparatus therefore forms an advantageous application of the overcurrent switching apparatus according to the invention and can advantageously be used, for example, to bridge an electronics module according to German laid-open specification DE 101 03 031 A1.

In a further refinement, the contact system is conductively connected to connecting terminals of the electronics module. This ensures that the electronics module is bridged in a simple manner when the threshold current is exceeded, by provision of a conductive connection between the connecting terminals via the contact system.

In a further refinement of the invention, the current detection means detect the current in the electronics module.

The invention will be explained in more detail in the following text on the basis of the drawing and of exemplary embodiments, with reference to the attached figures, in which:

DESCRIPTION OF THE INVENTION

Figure 1:
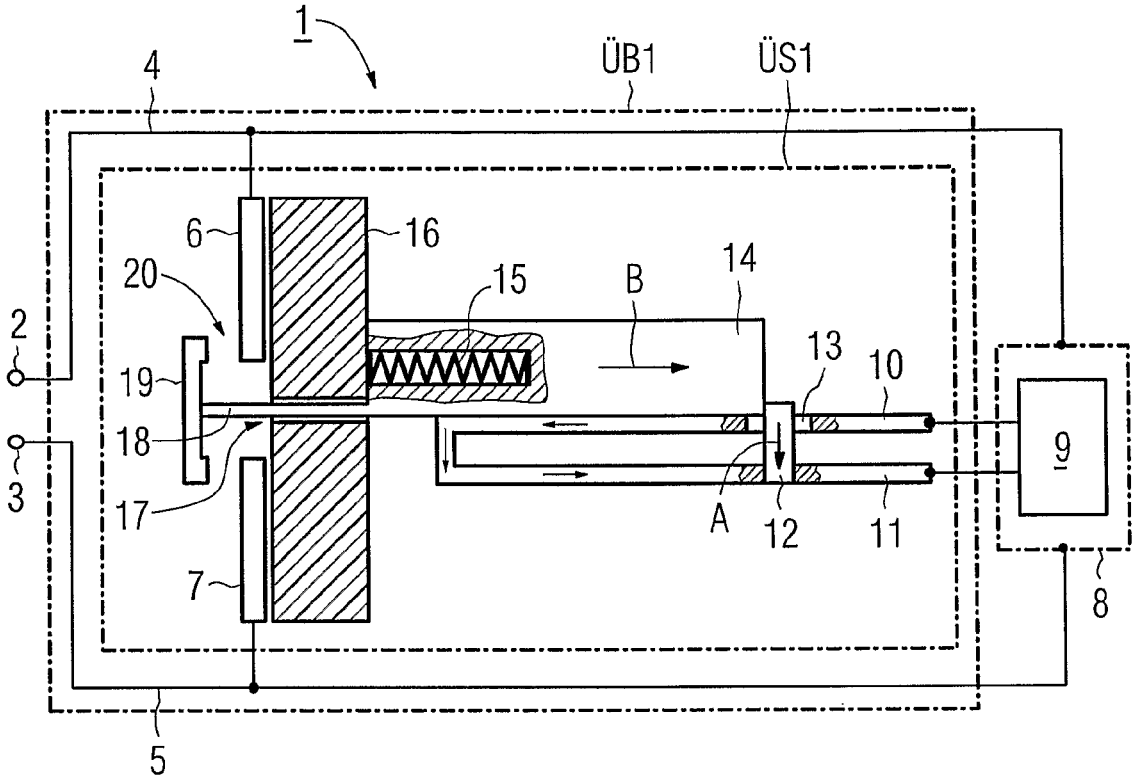
FIG. 1 shows a schematic illustration of an overcurrent switching apparatus according to the invention, in a first refinement of a bridging apparatus according to a first embodiment.

FIG. 1 shows an overcurrent switching apparatus ÜS1 of a bridging apparatus ÜB1 in an electronics module 1 with connecting terminals 2 and 3, which are connected via conductors 4 and 5 to a first opposing contact 6 and a second opposing contact 7 which, in the exemplary embodiment, are in the form of a first fixed contact 6 and a second fixed contact 7, as well as to a circuit unit 8. The circuit unit 8 comprises schematically illustrated electronic components 9, for example a plurality of switching elements such as IGBTs, diodes and an intermediate-circuit capacitor of a converter, which are connected to one another via current detection means in the form of connecting conductors 10, 11 as well as further connections which are not illustrated in the figures (see the circuit unit in the German laid-open specification DE 101 03 031 A1 as mentioned above). In this case, the connecting conductors 10 and 11 are arranged in the circuit unit 8 such that any overcurrent which occurs in the event of a fault flows via these connecting conductors 10 and 11. The connecting conductors 10 and 11 are in the form of busbars and are connected to one another at one end, so that a current flowing in the circuit unit 8 is passed via the busbars 10 and 11 in opposite senses. Coupling means 12 and 13 in the form of a holding pin 12 composed of an insulating material, as a blocking element 12, are firmly connected to the busbar 11, which is in the form of a deformable busbar, and the blocking element 12 extends through the busbar 10, through a cutout 13 therein. The coupling means 12, 13 are followed, as operating means 14, 15 and 18, by a moving carriage 14 which is blocked by the holding pin 12 and is prestressed by means of a spring 15 with respect to an insulating body 16 of the electronics module. A guide rod 18 of the carriage 14 extends through a cutout 17 in the insulating body 16, at the end of which guide rod 18 a moving contact 19 is arranged which, together with the first fixed contact 6 and the second fixed contact 7, forms a contact system 20.

The state of the apparatus as illustrated in FIG. 1 corresponds to the normal operating state of the electronics module 1 in which normal operating currents flow within the electronics module 1. In the event of a fault, for example caused by a short-circuit within the electronics module 1 or a switching element being incorrectly operated, a considerably greater current can flow in the electronics module than the normal operating current, because of the discharging of the capacitor in the circuit unit 8. Since the current is carried in opposite senses via the busbars 10 and 11, electromagnetic interaction between them results in a force which forces the busbars 10 and 11 apart from one another and in the process deforms the deformable busbar 11 such that the holding pin 12, which is firmly connected to the busbar 11, is moved in the direction of the movement arrow A, and releases the carriage 14. The force exerted by the spring 15 moves the carriage in the direction of the movement arrow B. In this case, the movement of the carriage 14 is guided by the guide rod 18 in the cutout 17 in the insulating body 16, and is limited by the formation of a closed contact between the moving contact 19 and the fixed contacts 6 and 7. A short-circuit current in the electronics module 1 therefore results in the contact system 20 being closed, as a result of which the remaining components in the electronics module 1 are bridged between the connecting terminals 2 and 3 of the electronics module 1 via the conductors 4 and 5 as well as the fixed contacts 6 and 7 and the moving contact 19. Bridging of electronics modules in a circuit arrangement comprising a plurality of modules, for example in a series circuit, is particularly necessary when the functionality of the circuit arrangement is intended to be maintained in the event of failure of a single electronics module as a result of a malfunction.

Figure 2:
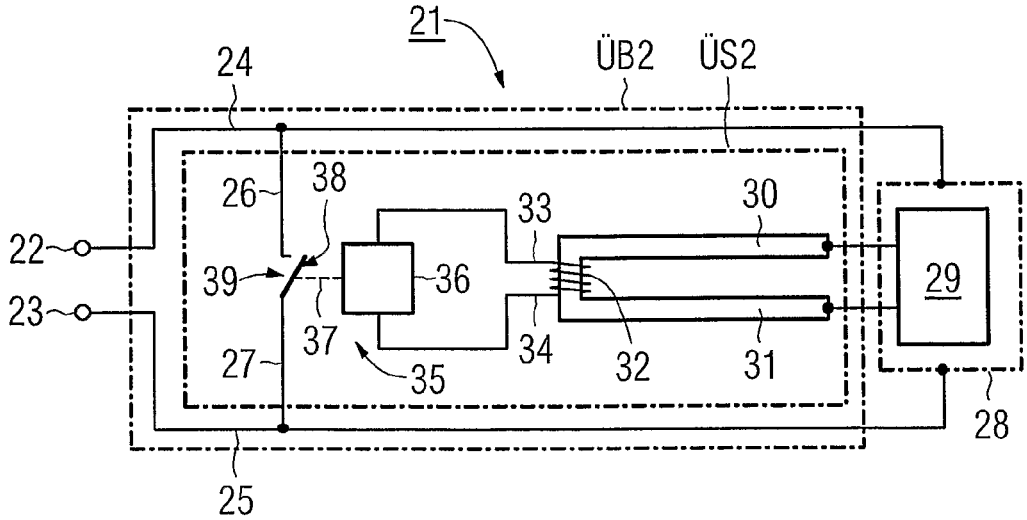
FIG. 2 shows a schematic illustration of an overcurrent switching apparatus according to the invention in a second refinement of a bridging apparatus according to a second embodiment.

FIG. 2 shows a further exemplary embodiment of an overcurrent switching apparatus ÜS2 of a bridging apparatus ÜB2 in an electronics module 21. Connecting terminals 22 and 23 of the electronics module 21 are connected via conductors 24 and 25 to contacts 26 and 27 and to a circuit unit 28 with schematically illustrated electronic components 29, for example switching elements which are not illustrated in the figures, such as IGBTs, capacitors and diodes. Connecting conductors 30 and 31 as well as further connections which are not illustrated in the figures are provided for connection of the components 29. The connecting conductors 30 and 31 are in this case arranged in the circuit unit 28 such that an overcurrent occurring in the event of a fault flows via these connecting conductors 30 and 31. The connecting conductors 30 and 31 are connected to one another at one end and, together with a coil 32, form current detection means 30, 31, 32. In this case, the coil 32 surrounds an area of the connecting conductors 30, 31, and is coupled to operating means 36 and 37 via coupling means 33 and 34 in the form of connecting lines 33 and 34. In the exemplary embodiment shown in FIG. 2, the operating means 36, 37 comprise a control apparatus 36 with a control connection 37 for controlling an electrical switch 38 which, together with the contacts 26 and 27, forms the contact system 39.

In the exemplary embodiment shown in FIG. 2, in the event of a failure of a semiconductor component, a short-circuit current that is produced by the capacitor in the circuit unit results in an induced voltage in the coil 32, which is compared in the control apparatus 36 with a threshold value. If the induced voltage is above the threshold value, then the switch 38 is closed via the control connection 37, such that the contact system 39 comprising the contacts 26, 27 and the switch 38 is closed, with the remaining elements of the electronics module 21 being bridged via the connecting terminals 22, 23 as well as the conductors 24, 25. The switch 38 is in this case designed such that, after being switched to the second state, in the exemplary embodiment of the closed state, it remains in this state even when the induced voltage in the coil is no longer present, once the short-circuit current has decayed. Bridging of electronics modules in a circuit arrangement comprising a plurality of modules, for example a series circuit, is particularly necessary when the functionality of the series circuit is intended to be maintained in the event of failure of an individual electronics module as a result of a malfunction. The switch 38 may in this case be in the form of a thyristor or an electromagnet, in which case, depending on the desired precision, the drive may be provided either directly by means of the voltage induced in the coil 32, or via the control apparatus 36 which, for example, may be in the form of a simple trigger circuit.

LIST OF REFERENCE SYMBOLS

ÜB1, ÜB2 Bridging apparatuses
ÜS1, ÜS2 Overcurrent switching apparatuses
Electronics module
2, 3 Connecting terminals
4, 5 Conductors
6 First fixed contact
7 Second fixed contact
8 Circuit unit
9 Electronic components
10, 11 Busbars
12 Holding pin
13 Bushing
14 Carriage
15 Spring
16 Insulating body
17 Bushing
18 Guide rod
19 Moving contact
20 Contact system
21 Electronics module
22, 23 Connecting terminals
24, 25 Conductors
26, 27 Contacts
28 Circuit unit
29 Components
30, 31 Connecting conductors
32 Coil
33, 34 Connecting lines
35 Electrical switching apparatus
36 Control apparatus
37 Control connection
38 Switching contact
39 Contact system
A, B Movement arrows

The invention claimed is:

1. An overcurrent switching apparatus for medium-voltage or high-voltage applications, comprising:
coupling means;
a contact system;
operating means; and
current detection means for switching said contact system associated with said current detection means, from a first state to a second state when a threshold current is exceeded, said current detection means disposed in a first current branch followed via said coupling means by said operating means configured to switch said contact system, disposed in a second current branch, from the first state to the second state, said current detection means having two busbar sections which run parallel to one another, in which a current is carried in opposite senses and of which at least one of said busbar sections can be deformed thus defining a deformable section, said deformable section can be changed from a normal position to an operating position by the threshold current being exceeded.

2. The overcurrent switching apparatus according to claim 1, wherein said coupling means contains a blocking element which is firmly connected to said deformable section.

3. The overcurrent switching apparatus according to claim 2, wherein said operating means contains a stressed spring and an operating member which can be spring-loaded and is configured such that, when said blocking element is in the normal position of said deformable section, said operating member is held in a position with said stressed spring and is released during the operating position of said deformable section.

4. The overcurrent switching apparatus according to claim 3, wherein said operating member is a moving carriage which can be stressed by said stressed spring and has a rigidly connected guide rod.

5. The overcurrent switching apparatus according to claim 1,
further comprising first and second opposing contacts; and
wherein said contact system is formed from a moving contact which is rigidly connected to said operating means, to form a conductive connection between said first and second opposing contacts.

6. A bridging apparatus for an electronics module, the bridging apparatus comprising:
an overcurrent switching apparatus, containing:
coupling means;
a contact system;
operating means; and
current detection means for switching said contact system associated with said current detection means, from a first state to a second state when a threshold current is exceeded, said current detection means disposed in a first current branch followed via said coupling means by said operating means configured to switch said contact system disposed in a second current branch, from the first state to the second state, said current detection means configured to switch said contact system associated with said current detection means from the first state, in which the electronics module is connected to a circuit arrangement, to the second state, in which the electronics module bridges the circuit arrangement, when the threshold current is exceeded in the electronics module.

7. The bridging apparatus according to claim 6, wherein said contact system is conductively connected to connecting terminals of the electronics module.

8. The bridging apparatus according to claim 6, wherein said current detection means detects a current in the electronics module.

* * * * *